US005496147A

United States Patent [19]

Taube

[11] Patent Number: 5,496,147

[45] Date of Patent: Mar. 5, 1996

[54] BARREL HANDLING DEVICE

[75] Inventor: Donald R. Taube, Fort Wayne, Ind.

[73] Assignee: Barrel Racking Systems, Inc., Fort Wayne, Ind.

[21] Appl. No.: 289,948

[22] Filed: Aug. 12, 1994

[51] Int. Cl.[6] ..... B66F 9/18

[52] U.S. Cl. ..... 414/607; 414/420; 414/620; 414/641; 294/90

[58] Field of Search ..... 414/607, 620, 414/621, 622, 641, 420, 422, 450, 642; 294/29, 31.1, 90

[56] References Cited

U.S. PATENT DOCUMENTS

| | | | |
|---|---|---|---|
| 2,545,021 | 3/1951 | Coupland . | |
| 2,614,711 | 10/1952 | Houser . | |
| 2,645,372 | 7/1953 | Broersma | 414/620 |
| 2,689,663 | 9/1954 | Shramek . | |
| 3,206,052 | 9/1965 | Kennedy | 414/620 X |
| 3,438,523 | 4/1969 | Vik | 414/607 X |
| 3,512,670 | 5/1970 | Howard . | |
| 3,718,228 | 2/1973 | Lund et al. . | |
| 3,893,579 | 7/1975 | Glewwe . | |
| 3,971,485 | 7/1976 | Hoppey | 414/621 X |
| 4,130,212 | 12/1978 | Gatilao . | |
| 4,243,354 | 1/1981 | Garcia | 414/607 |
| 4,318,661 | 3/1982 | Helm | 414/607 |
| 4,561,822 | 12/1985 | Schmook | 414/607 X |
| 4,618,306 | 10/1986 | Dorsch | 414/607 X |
| 4,685,713 | 8/1987 | Van der Hulst et al. | 294/90 |
| 4,911,605 | 3/1990 | Berg | 414/623 |
| 4,983,092 | 1/1991 | Richards | 414/420 X |
| 5,009,565 | 4/1991 | Esau | 414/620 x |
| 5,020,963 | 6/1991 | Okada | 414/607 |
| 5,230,599 | 7/1993 | Orr | 414/607 |
| 5,342,163 | 8/1994 | Yost | 294/90 X |

OTHER PUBLICATIONS

Liftomatic Drum Dumper Brochure, Feb. 1991.

Liftomatic SDXA-1 Automatic Drum Dumper Brochure, Feb. 1991.

*Primary Examiner*—Michael S. Huppert

*Assistant Examiner*—James W. Keenan

*Attorney, Agent, or Firm*—Taylor & Knuth

[57] ABSTRACT

The invention is directed to an apparatus for lifting and moving a barrel. The apparatus includes a frame which can be connected to a fork lift, at least one support member pivotably connected to the frame for engaging and supporting the barrel, a power source for selectively moving the support member(s) from a substantially vertical to a substantially horizontal position and vice versa, and an apparatus for removably attaching to the bead of the barrel.

20 Claims, 5 Drawing Sheets

BARREL HANDLING DEVICE

BACKGROUND OF THE INVENTION

1. Field of the Invention

The present invention relates to a barrel handling device, and, more particularly, to a barrel handling device that can lift and rotate a barrel from a vertical to a horizontal position.

2. Description of the Related Art

Barrels or fifty-five gallon drums are typically used for holding or storing a fluid. Fluids stored within such barrels or drums can weigh ten pounds or more per gallon of fluid. With many fluids, the weight contained in a fifty-five gallon drum can exceed one thousand pounds. A problem with fluid-filled barrels is that because of the great weight, a fully-filled barrel cannot be manually lifted and moved.

Devices for moving and lifting filled barrels are known in the art. Certain of such devices can be attached to a forklift. For example, U.S. Pat. No. 3,512,670 issued to Howard discloses a device for turning a barrel ninety degrees and which is attached to a forklift truck. Pad assemblies attach to the sides of a barrel at a pivot point which is offset from the barrel's center of gravity. The barrel pivots about the pivot point from a vertical to a horizontal position upon lifting the barrel. Upon lifting the barrel, the weight of the barrel against the pad assemblies rotates the pads and the barrel.

There are disadvantages associated with a barrel handling device of the type disclosed in Howard. For example, the barrel handling device of Howard does not disclose or suggest a structure for rotating a barrel back to a vertical position after the barrel has been rotated from a vertical to a horizontal position. Another disadvantage of Howard is that the barrel handling device cannot position a barrel in a plurality of positions between a vertical and a horizontal position. Rather, Howard discloses turning a barrel ninety degrees from a vertical to a horizontal position. In addition, the barrel handling device of Howard does not allow a heavy barrel to be lifted and rotated smoothly and without jerking or unpredictable movements.

Moreover, U.S. Pat. No. 3,893,579 issued to Glewwe discloses a device for dumping a drum and which is attached to a lift truck. The drum dumping device lifts a barrel from a vertical position and pivots the barrel to dump the contents of the barrel. However, as with Howard, Glewwe cannot be used to rotate a barrel back to a vertical position once rotation from a vertical to a horizontal position has been achieved. In addition, the drum dumping device disclosed in Glewwe cannot place a barrel in a variety of positions between a vertical position and a horizontal position.

It is also known in the art to use a hydraulic system to tilt a barrel, as disclosed in U.S. Pat. No. 2,545,021 issued to Coupland et al. The hydraulic system as disclosed in Coupland et al. has sufficient lifting force to tilt a barrel of great weight. However, the barrel is merely tilted back over the forks of a forklift in order to transport the barrel. The barrel cannot be rotated from a vertical to a horizontal position, or vice versa, or to any other than the tipped position.

A problem with conventional barrel handling devices is that although it may be desirable to move or maintain a barrel into some position other than a vertical position, for example in a horizontal position, or in a plurality of positions between a vertical position and a horizontal position, conventional devices are not capable of lifting and rotating a barrel from a vertical position to a horizontal position or to a plurality of other positions.

Another problem with conventional barrel handling devices is that the oft-encountered great weight of the barrel cannot be moved and manipulated smoothly, but that such conventional devices handle barrels in a jerky and unpredictable manner.

What is needed in the art is: a barrel handling device that can lift and rotate a barrel from a vertical to a horizontal position; a barrel handling device that can lift and rotate a barrel from a vertical to any of a plurality of positions between a vertical and a horizontal position; and a barrel handling device which can smoothly lift and rotate a barrel of great weight without jerky or unpredictable movements.

SUMMARY OF THE INVENTION

The present invention provides a barrel handling device that can lift and rotate a barrel from a vertical to a horizontal position, and vice versa.

The invention comprises, in one form thereof, an apparatus for lifting and moving a barrel. The apparatus includes a frame which can be connected to a fork lift, at least one support member pivotably connected to the frame for engaging and supporting the barrel, a power source for selectively moving the support member(s) from a substantially vertical to a substantially horizontal position and vice versa, and an apparatus for removably attaching to the bead of the barrel.

An advantage of the present invention is that it can lift and rotate a barrel from a vertical to a horizontal position, and vice versa.

Another advantage is that the present invention can lift and rotate a barrel from a vertical position to any of a plurality of positions between a vertical and a horizontal position.

Yet another advantage is that the present invention can smoothly lift, rotate, and move a barrel of great weight without jerky or unpredictable movements.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
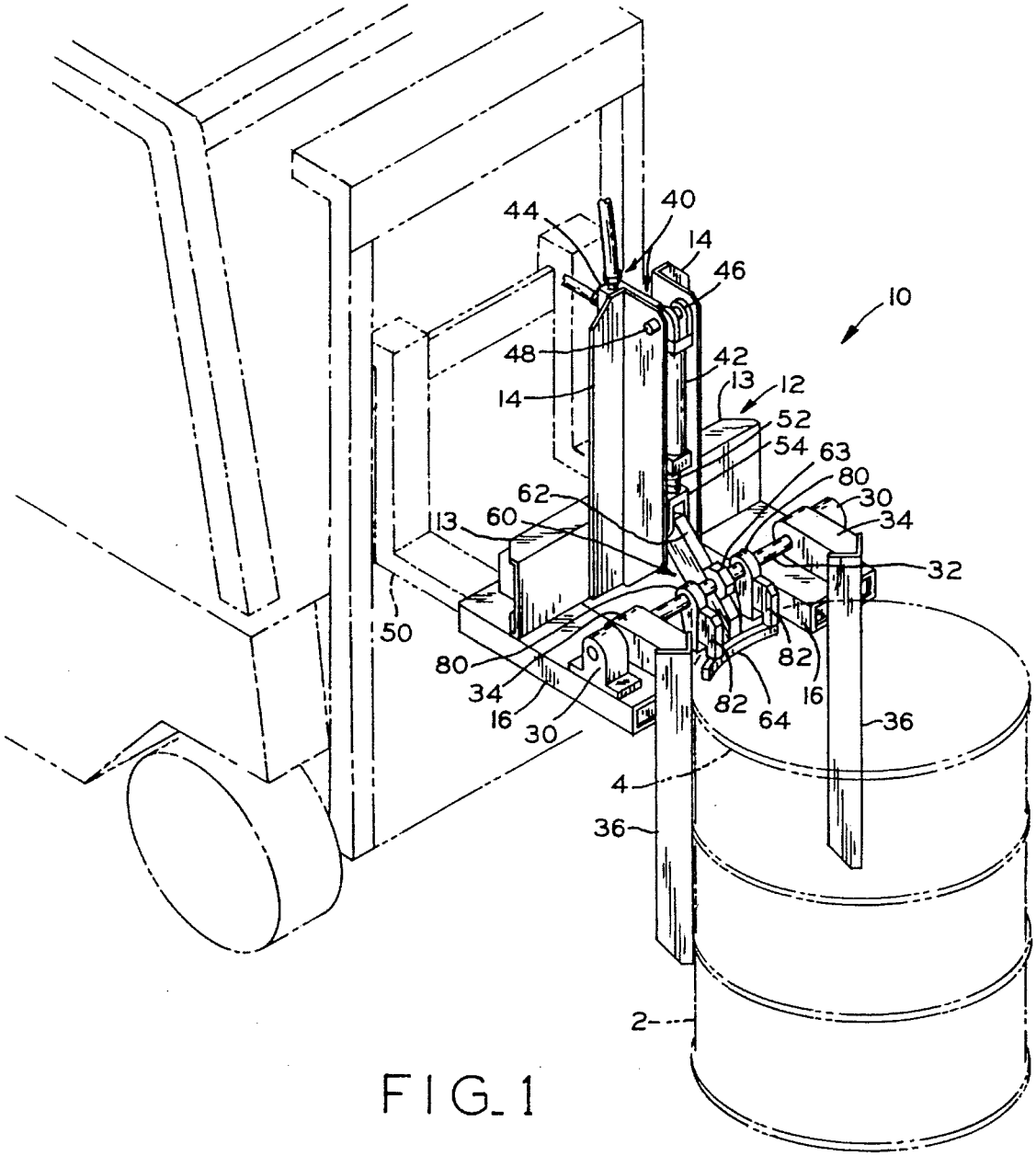
FIG. 1 is a perspective view of an embodiment of the present invention attached to a fork lift and attached to a barrel in a vertical position.

Corresponding reference characters indicate corresponding parts throughout the several views. Although the drawings represent embodiments of the present invention, the drawings are not necessarily to scale and certain features may be exaggerated in order to better illustrate and explain the present invention. The exemplification set out herein illustrates one preferred embodiment of the invention, in one form, and such exemplification is not to be construed as limiting the scope of the invention in any manner.

DETAILED DESCRIPTION OF THE INVENTION

In accordance with the present invention, a barrel handling device 10 includes a frame 12, support members 36, hydraulic system 40, and clamping device 60.

Figure 2:
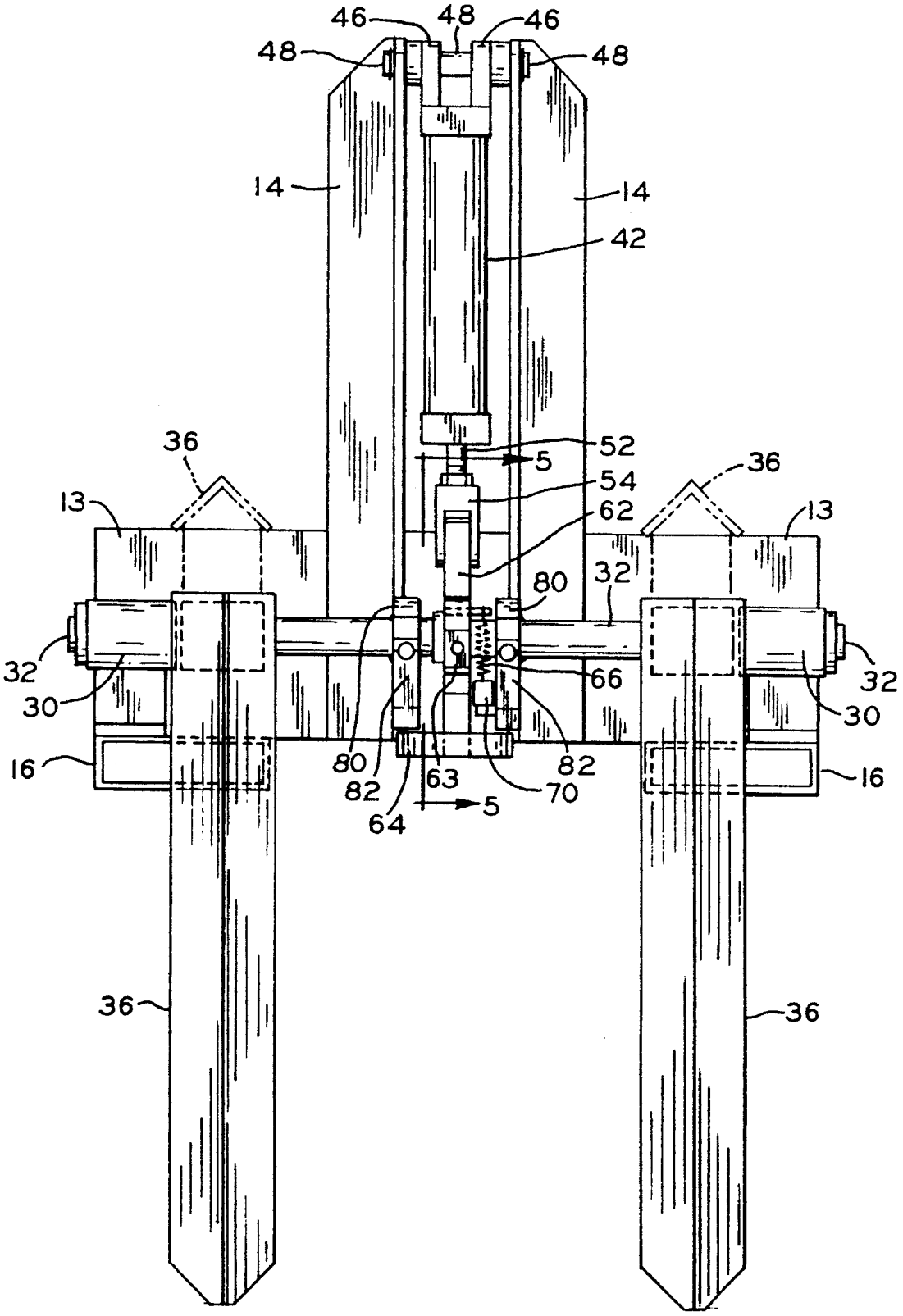
FIG. 2 is a front view of the embodiment shown in FIG. 1.
Figure 3:
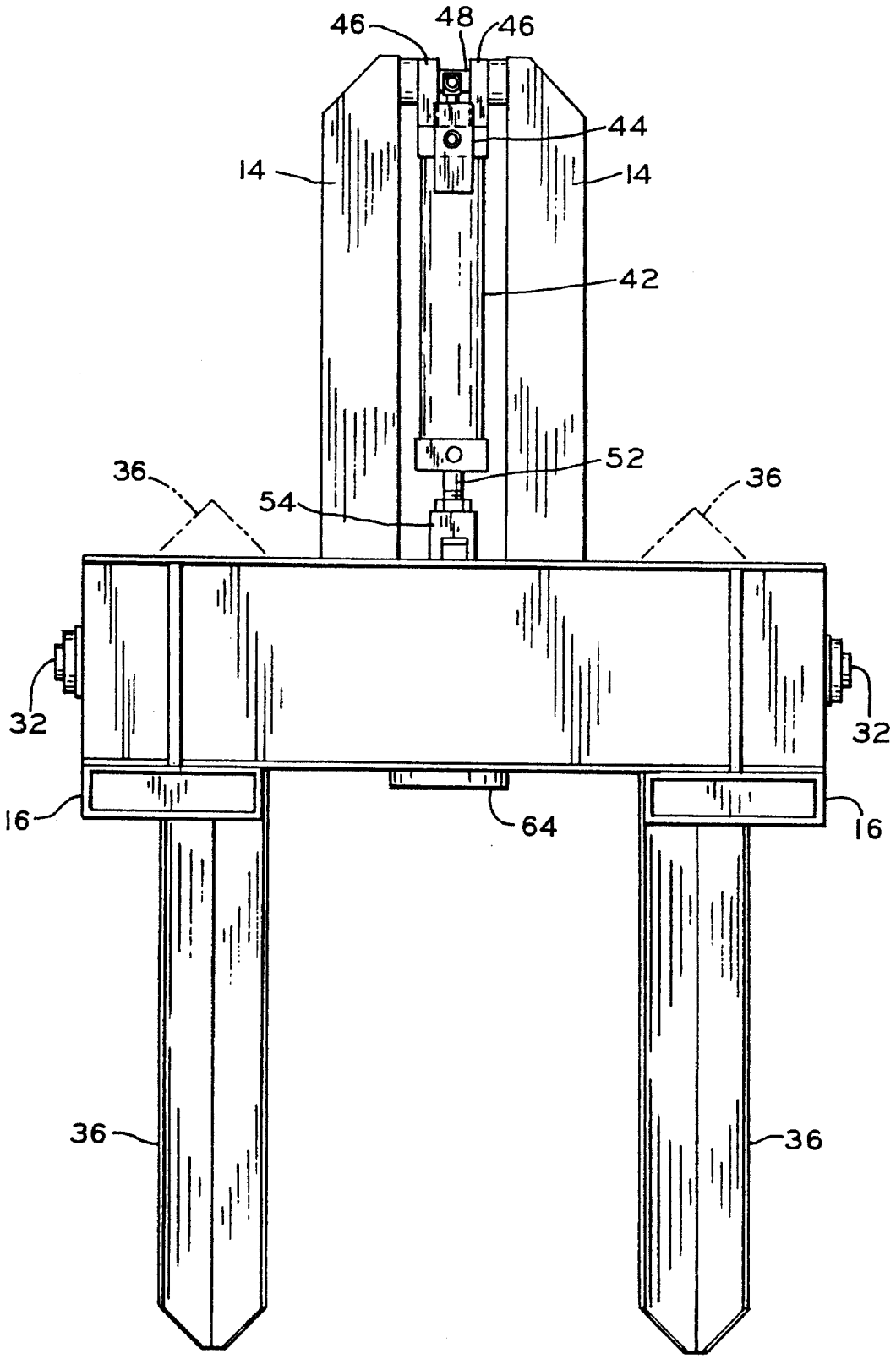
FIG. 3 is a rear view of the embodiment shown in FIG. 1.

Frame 12 (FIGS. 1, 2, and 3) includes two channels 16, into which are inserted forks 50 of a forklift (shown in phantom in FIG. 1). Frame 12 also includes crosspiece 13 which is transversely and rigidly attached to channels 16, and uprights 14 which are transversely and rigidly attached to crosspiece 13.

Bearing blocks 30 are rigidly attached to channels 16 and rotatably carry a rod 32. Extensions 34 are disposed substantially parallel to each other, and are rigidly connected to and rotate with rod 32. Support members 36 are rigidly attached to extensions 34.

Hydraulic system 40 includes hydraulic cylinder 42, in which is reciprocally disposed a ram 52. Hydraulic system 40 also includes counter-balance valve 44, which is described in more detail hereinafter. Collars 46 are rigidly attached to the top of hydraulic cylinder 42, and are pivotably attached to uprights 14 by pin 48. Yoke 54 is attached to the bottom of ram 52.

Connected at the top of ram 52 is a counter-balance valve 44. The cracking pressure of counter-balance valve 44 is inversely proportional to the weight of the barrel being lifted. That is, with a heavier barrel, the amount of force which is required to crack open the valve and thereby allow fluid to flow therethrough is relatively small. Conversely, with a lighter barrel, the amount of force which is required to crack open the valve and thereby allow fluid to flow therethrough is relatively large. If a standard valve were used, the weight of a barrel would cause support members 36 to jerk in a downward direction when the valve was cracked open. In contrast, counter-balance valve 44 provides smooth operation when pivoting the barrel from a horizontal to a vertical position, and vice versa. In the embodiment shown in the drawings, counter-balance valve 44 is a valve manufactured by Sun Hyd. Corp., part number CBCA-LHN-ECJ.

Figure 5:
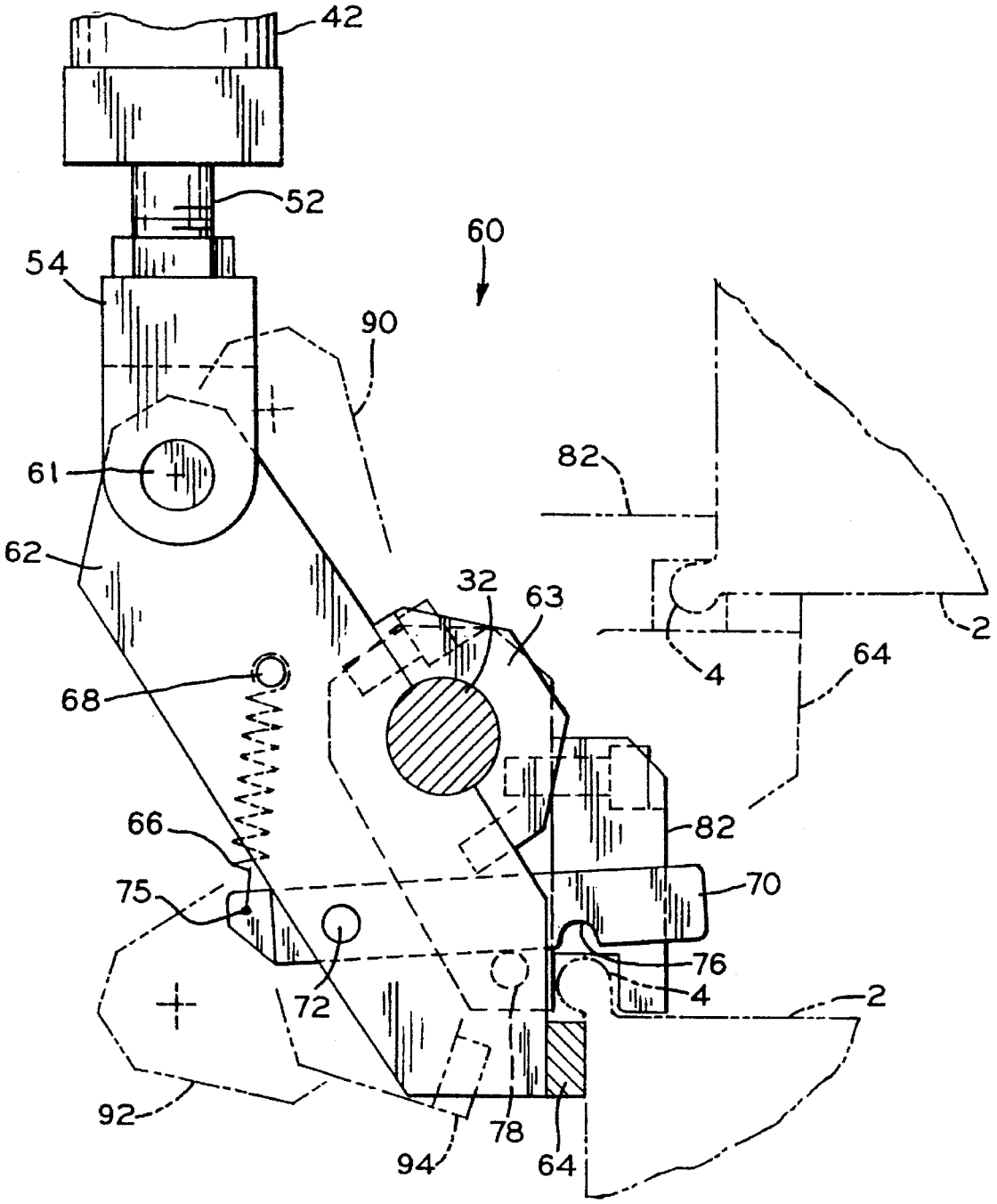
FIG. 5 is an enlarged, fragmentary sectional view taken along line 5—5 in FIG. 2, showing engagement with a barrel.

Clamping device 60 (FIGS. 1 and 5) includes lever arm 62 coupled to yoke 54 by bolt 61. Block 63 rotatably secures lever arm 62 to rod 32, whereby lever arm 62 is free to pivot about rod 32. Engaging arm 64 is affixed at the lower end of lever arm 62 and fits under the outside of barrel rim 4 (FIG. 5). Arm 70 is pivotably attached to lever arm 62 by pin 72. Spring 66 is attached at one end thereof to bolt 68 extending from lever arm 62, and is attached at another end thereof to an opening 75 in lever arm 70. Notch 76 of arm 70 fits over pin 78. Clamping device 60 also includes members 80 which are rigidly attached to rod 32. Tabs 82 are in turn rigidly connected to members 80 and fit over the inside of rim 4 at the top of the barrel 2.

Figure 4:
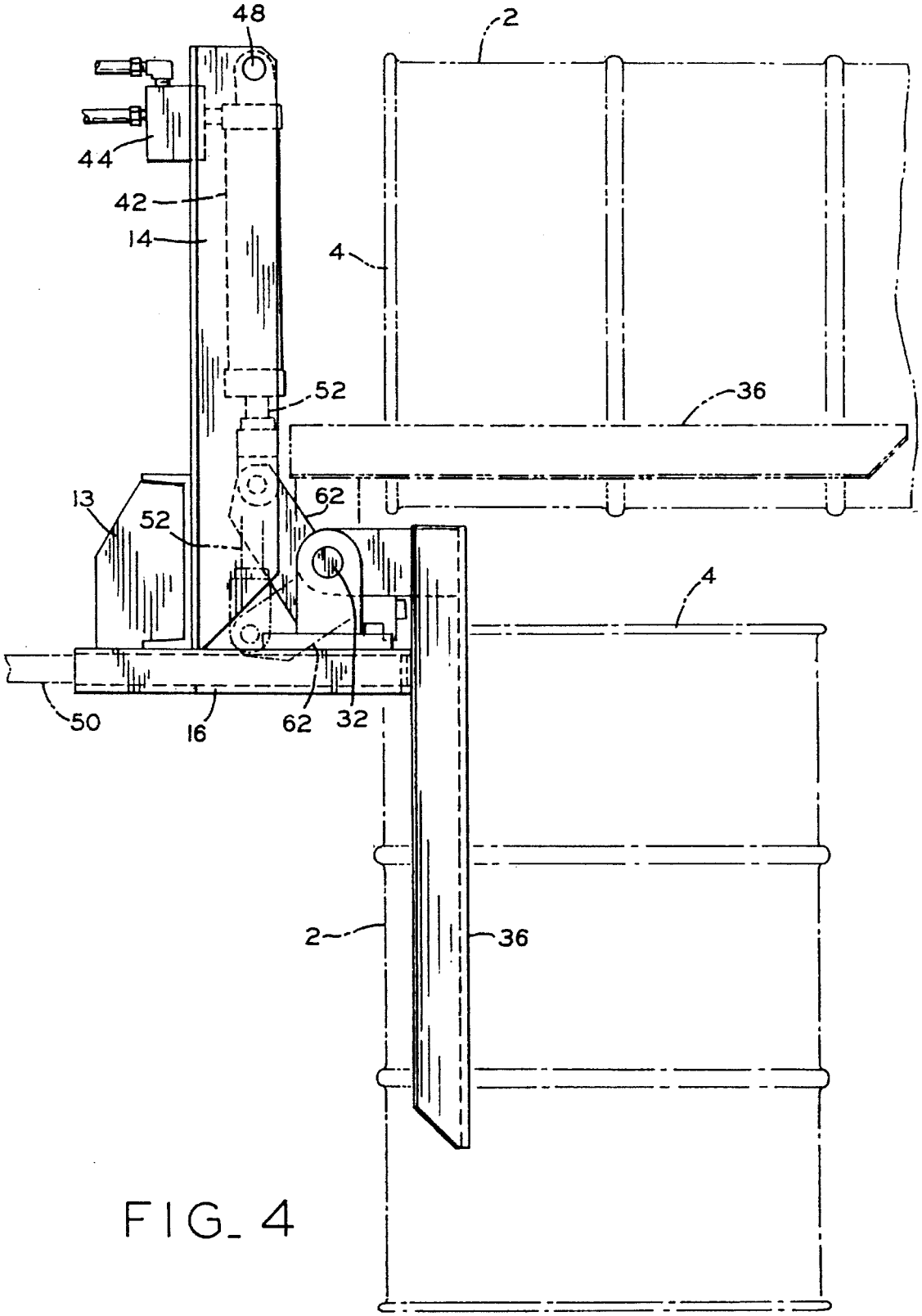
FIG. 4 is a side view of the embodiment shown in FIG. 1.

To lift a barrel 2 from a vertical to a horizontal position, the barrel handling device 10 is placed in its first position, with support members 36 in a vertically downward position, as shown in FIG. 1. Device 10 is brought near barrel 2, and support members 36 placed against barrel 2. Device 10 is then moved in a vertically downward direction, whereby tabs 82 slide over the inside of barrel rim 4, which engages arm 70 and rotates arm 70 about pin 72 to disengage notch 76 from pin 78. Disengagement of notch 76 from pin 78 allows engaging arm 64 to rotate toward tabs 82. Hydraulic ram 52 is then moved in a downward direction by supplying hydraulic fluid within hydraulic cylinder 42, thereby pivoting lever arm 62 and engaging arm 64 to a clamped position under the outside of rim 4. Barrel rim 4 is thus clamped between tabs 82 and engaging arm 64. As ram 52 continues in a downward direction, support members 36 pivot into a horizontal position as shown in FIG. 4. Support members 36 thus raise the barrel upwards to a horizontal position, from which position the barrel may then be placed upon a storage rack or the like.

Referring now to FIG. 5, lever arm 62 and engaging arm 64 are shown in various positions in phantom lines. To wit, lever arm 62 is disposed in a position indicated by phantom line 90 when ram 52 is in a retracted position, and lever arm 62 is disposed in another position indicated by phantom line 92 when ram 52 is in an extended position. When lever arm 62 is in the position shown by phantom line 90, engaging arm 64 is disposed in an unclamped position shown by phantom line 94. Additionally, when engaging arm 64 is disposed in the position shown by phantom line 94, notch 76 of arm 70 matingly engages pin 78.

The embodiment of the present invention shown in the drawings is powered by a hydraulic system 40. Alternatively, mechanical power may be provided by incorporating a system of gears, shafts, threaded shafts, pulleys and/or belts that operate the barrel handling device to achieve the same operation as described when using a hydraulic system as the source of power.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for lifting and moving a barrel, said apparatus adapted for connection to a fork lift, said apparatus comprising:

a frame connectable to a fork lift;

at least one support member pivotally connected to said frame for directly engaging and supporting the barrel;

a barrel bead clamping device connected to one of said frame and said support member, and movable between a clamped position and an unclamped position;

means, interconnecting said frame with each of said at least one support member and said bead clamping device, for selectively and simultaneously moving each of said support member and said bead clamping device, said moving means moving said support member from a substantially horizontal position to a substantially vertical position, and from said substantially vertical position to said substantially horizontal position, said moving means further moving said bead clamping device from said clamped position to said unclamped position, and from said unclamped position to said clamped position.

2. The apparatus of claim 1, wherein said moving means is selectively movable to one of a plurality of positions.

3. The apparatus of claim 1, wherein said at least one support member comprises two elongated members disposed substantially parallel to each other.

4. The apparatus of claim 3, further comprising a rod connected to each of said elongated members and rotatably carried by said frame.

5. The apparatus of claim 4, wherein said bead clamping device comprises at least one upper clamp affixed to said rod and an engaging arm rotatably carried by said rod, said upper clamp being selectively movable to a position whereby a bead of the barrel is clamped between said upper clamp and said engaging arm.

6. The apparatus of claim 5, wherein said moving means comprises a hydraulic ram.

7. The apparatus of claim 1, wherein said frame comprises two channel members for connection to the forklift.

8. An apparatus for lifting and moving a barrel having a bead, said apparatus adapted for connection to a fork lift, said apparatus comprising:

a frame connectable to a fork lift;

at least one support member pivotally connected to said frame for directly engaging and supporting the barrel;

a barrel bead clamping device connected to one of said frame and said support member, and movable between a clamped position and an unclamped position; and means, interconnecting said frame with each of said at least one support member and said bead clamping device, for selectively and simultaneously moving each of said support member and said bead clamping device, said moving means moving said support member to a plurality of positions between and including a substantially vertical position and a substantially horizontal position, and maintaining said support member in said selected position, said moving means further moving said bead clamping device from said clamped position to said unclamped position, and from said unclamped position to said clamped position.

9. The apparatus of claim 8, wherein said at least one support member comprises two elongated members disposed substantially parallel to each other.

10. The apparatus of claim 9, further comprising a rod connected to each of said elongated members and rotatably carried by said frame.

11. The apparatus of claim 11, wherein said bead clamping device comprises at least one upper clamp affixed to said rod and an engaging arm rotatably carried by said rod, said upper clamp being selectively movable to a position whereby the bead of the barrel is clamped between said upper clamp and said engaging arm.

12. The apparatus of claim 11, wherein said moving means comprises a hydraulic ram.

13. The apparatus of claim 8, wherein said frame comprises two channel members for connection to the forklift.

14. An apparatus for lifting and moving a barrel having a bead, said apparatus adapted for connection to a fork lift, said apparatus comprising:

a frame connectable to a fork lift;

at least one support member pivotally connected to said frame for engaging and supporting the barrel;

a barrel bead clamping device connected to one of said frame and said support member, and movable between a clamped position and an unclamped position; and moving and preventing means, including a hydraulic system interconnecting said frame with each of said at least one support member and said barrel bead clamping device, for selectively and simultaneously moving each of said support member and said bead clamping device, said moving and preventing means moving said support member to one of a plurality of positions, and moving said bead clamping device from said clamped position to said unclamped position, and from said unclamped position to said clamped position, said moving and preventing means preventing abrupt movement of the barrel when said at least one support member is moved to said one of a plurality of positions.

15. The apparatus of claim 14, wherein said moving and preventing means comprises a counter-balance valve.

16. The apparatus of claim 15, wherein a cracking pressure of said counter-balance valve is inversely proportional to the weight of the barrel.

17. The apparatus of claim 14, wherein said at least one support member comprises two elongated members disposed substantially parallel to each other.

18. The apparatus of claim 17, wherein said frame comprises two channel members for connection to the forklift.

19. The apparatus of claim 18, further comprising a rod connected to each of said elongated members and rotatably carried by said frame.

20. The apparatus of claim 19, wherein said bead clamping device comprises at least one upper clamp affixed to said rod and an engaging am rotatably carried by said rod, said upper clamp being selectively movable to a position whereby the bead of the barrel is clamped between said upper clamp and said engaging arm.

* * * * *

UNITED STATES PATENT AND TRADEMARK OFFICE

CERTIFICATE OF CORRECTION

PATENT NO. : 5,496,147

DATED : March 5, 1996

INVENTOR(S) : Donald R. Taube

It is certified that error appears in the above-indentified patent and that said Letters Patent is hereby corrected as shown below:

COLUMN 6

Line 41, after the word "engaging", delete "am" and substitute --arm-- therefor.

Signed and Sealed this

Thirtieth Day of July, 1996

*Attest:*

*Attesting Officer*

BRUCE LEHMAN

*Commissioner of Patents and Trademarks*